United States Patent [19]

Ross et al.

[11] 4,076,365

[45] Feb. 28, 1978

[54] ELECTRICAL CONNECTOR HAVING CONDUCTOR SPREADING MEANS

[75] Inventors: Milton Dean Ross; Andrew Graham Boutcher; Walter Clifton Shatto, all of Harrisburg, Pa.

[73] Assignee: AMP Incorporated, Harrisburg, Pa.

[21] Appl. No.: 743,897

[22] Filed: Nov. 22, 1976

[51] Int. Cl.[2] ..... H01R 13/58

[52] U.S. Cl. ..... 339/107; 339/14 R

[58] Field of Search ..... 339/107, 17 F, 17 L, 339/17 R, 61 R, 61 M, 96, 97 R, 98, 99 R, 14 R

[56] References Cited

U.S. PATENT DOCUMENTS

| | | | |
|---|---|---|---|
| 3,569,900 | 3/1971 | Uberbacher | 339/14 R |
| 3,737,833 | 6/1973 | Jerominek | 339/17 F |

*Primary Examiner*—Joseph H. McGlynn

*Assistant Examiner*—DeWalden W. Jones

*Attorney, Agent, or Firm*—Robert W. Pitts; William J. Keating; Frederick W. Raring

[57] ABSTRACT

Multi-contact electrical connector comprises two housing parts which can be telescopically assembled to each other. Means are provided on at least one of the housing parts to spread or otherwise reposition the conductors on the end of a cable, which has been positioned between opposed surfaces of the two housing parts, when the housing parts are assembled to each other so that after assembly, the conductors will be precisely located adjacent to the mating face of the assembled housing. Electrical contact means are provided adjacent to the mating end of the connector face which electrically contacts the conductors and permits them to be connected to further conductors on a printed circuit board or in a complementary connector.

28 Claims, 17 Drawing Figures

ELECTRICAL CONNECTOR HAVING CONDUCTOR SPREADING MEANS

BACKGROUND OF THE INVENTION

This invention relates to multi-contact electrical connectors for connecting a plurality of conductors in a cable to conductors external to the cable. The herein disclosed embodiment of the invention is particularly intended for use with so called transmission cables which comprises a plurality of extremely fine conductors in side-by-side parallel relationship, although other uses for the invention will be apparent to those skilled in the art.

U.S. Pat. Nos. 3,891,013 and 3,871,072 disclose and claim a technique for spreading a plurality of side-by-side conductors and locating the conductors in precise positions relative to each other so that terminals can be secured by crimping or otherwise onto the ends of the conductors. These prior U.S. patents, and other issued U.S. patents referred to in the specifications thereof, disclose methods and apparatus which are primarily intended for relatively coarse gauge conductors. The instant invention is directed to the use of these techniques described in U.S. Pat. Nos. 3,891,013, 3,871,072, 3,887,999 and 3,939,933 for assembling electrical connectors in a flat conductor cable in which the conductors are extremely close together. The invention is further directed to the achievement of an electrical connector which has a self-contained means for locating the conductors in the cable at precise positions when the connector is installed on the cable. U.S. Pat. No. 3,835,445 also discloses a related connector fabrication technique.

One prior art connector is shown in FIGS. 15 and 16. The connector depicted therein is often referred to as a paddleboard connector. This paddleboard connector comprises a printed circuit board with traces leading from a soldered contact with the conductor in the transmission cable to the terminals in a housing. This paddleboard connector will subsequently be more fully described.

In accordance with a preferred embodiment of the invention, the connector is comprised of two housing parts which are adapted to be telescopically assembled to each other with the conductors from a cable between opposed surfaces of the housing parts. During assembly, the conductors are separated or spread and precisely located relative to each other at the mating end of the connector housing. Electrical contact terminals which constitute part of the connector assembly, are brought into engagement with the conductors after assembly of the housing parts to each other and engage the conductors to establish electrical contact therewith. The contact terminals have means for establishing electrical contact with further conductors such as the conductors on a printed circuit board or contact terminals in a complementary connector.

It is accordingly, an object of the invention to provide an improved multi-contact electrical connector. A further object is to provide a connector having means for separating and precisely locating the conductors in a cable upon assembly of the connector to the cable. A further object is to provide an improved connector for flat transmission cable having a plurality of parallel conductors on closely spaced centers. A further object is to provide a connector which can be installed on the end of a cable in a minimum amount of time by a technician at a worksite.

Another object is to provide a connector in which a wire termination can be made without degrading the electrical performance of the system. Proper impedance matching and low crosstalk are therefore objects of this invention. Accordingly, this invention lends itself to use of a template design in which wire spacing can be regulated to achieve these desirable electrical characteristics.

Furthermore, an object of this invention is to provide a means of spreading a plurality of closely spaced conductors to a centerline spacing upon which all of the conductors can be simultaneously terminated. Consistent with this objective is the desirability of interconnecting conductors on one centerline to terminals on a different centerline by means of a single termination, thereby increasing the termination efficiency and minimizing the number of terminations which could be defective.

These and other objects of the invention are achieved in preferred embodiments thereof which are briefly described in the foregoing abstract, which are described in detail below.

DETAILED DESCRIPTION OF THE INVENTION

Figure 1:
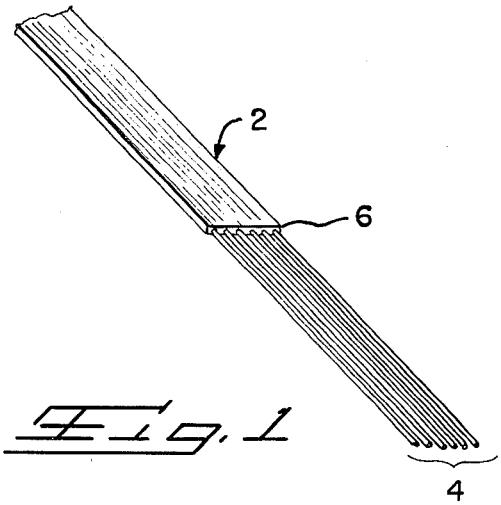
FIG. 1 is a perspective view of a flat cable having a plurality of conductors in side-by-side relationship, the insulation having been removed from the end portion of the cable.

The herein disclosed embodiments of the invention are particularly intended for use on cable of the type shown at 2 comprising a plurality of conductors 4 in side-by-side parallel relationship in a continuous sheet of insulating material 6. Where the cable is intended for data transmission, the conductors may be, for example, of 33 AWG gauge and be spaced apart by distances of 0.02 inch or less. In general, these conductors will be round wires. It will be obvious that it is desirable to spread the conductors when it is necessary to install a connector on the cable. As shown in FIG. 1, the insulation is stripped from the end portion of the cable prior to assembly of the connectors described below to the cable.

Figure 15:
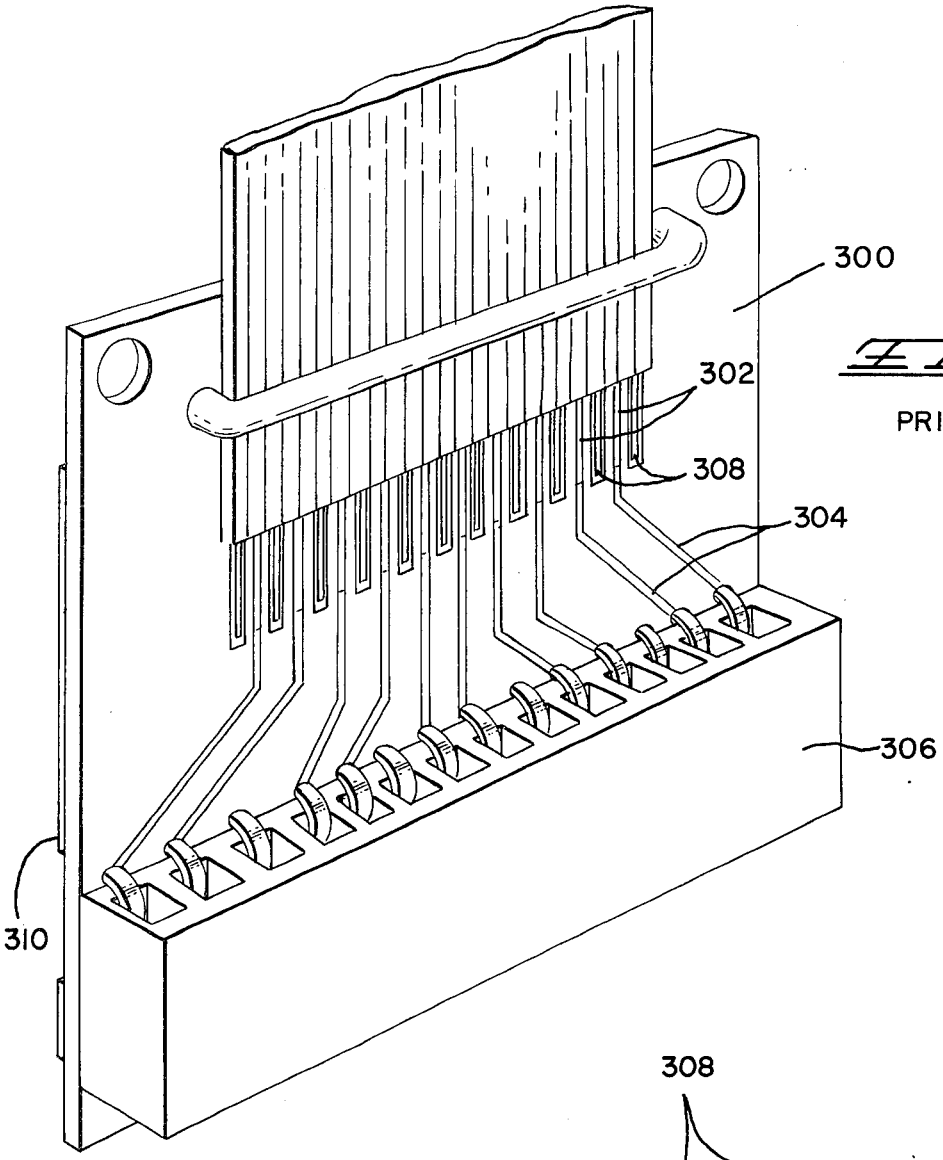
Fig. 15 PRIOR ART
FIG. 15 is a perspective view of a prior art paddleboard connector.
Figure 16:
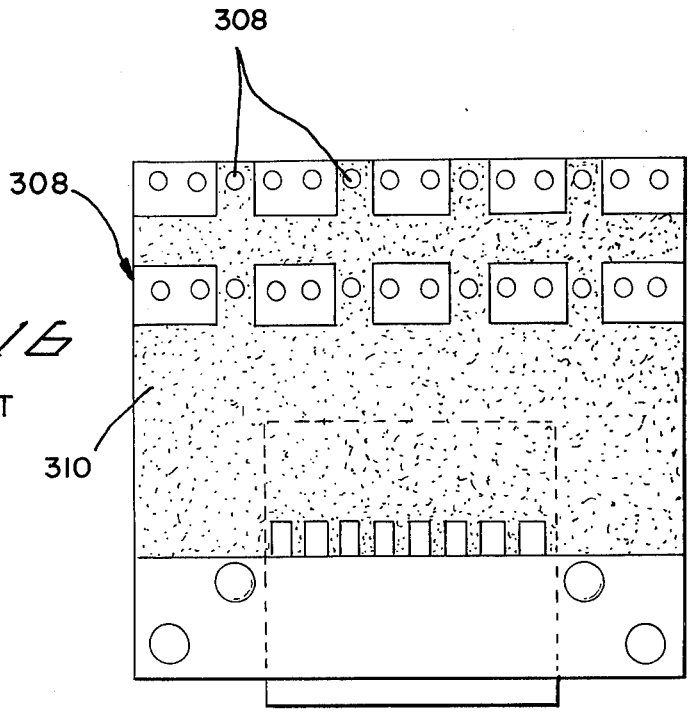
Fig. 16 PRIOR ART
FIG. 16 is a view of the rear of the prior art paddleboard connector showing the ground plane.

FIGS. 15 and 16 show a prior means of connecting flat cable where the centerlines of the wires must be altered. In the prior art connector shown in FIGS. 15 and 16, the stripped ends of the individual wires in a transmission cable are soldered to pads on a printed circuit board or paddleboard 300. Signal wires 302 are soldered to pads connected to traces 304 which lead to appropriate terminal locations in connector housing 306. Ground wire contacts 308 extend through the board to contact ground plane 310. Ground wires in the transmission cable are soldered to pads in contact with ground plane 310. Post receptacle housing 306 is mounted on one end of board 300 with signal and ground wires in contact with appropriate terminal positions.

Figure 2:
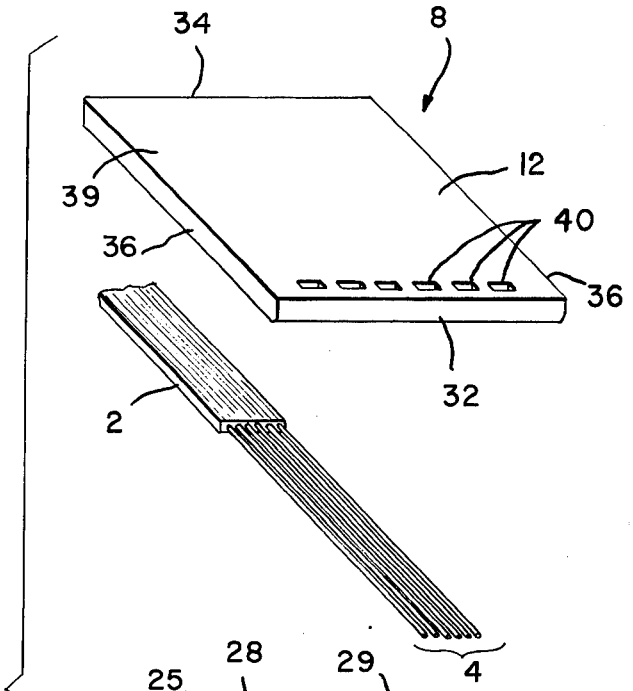
FIG. 2 is a perspective exploded view of one form of connector in accordance with the invention.
Figure 3A:
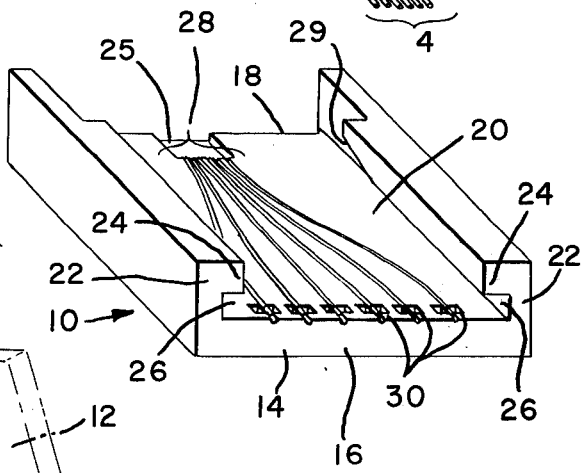
FIG. 3A and 3B illustrate successive stages in the installation process in which the connector is assembled to the end of the cable.
Figure 3A:
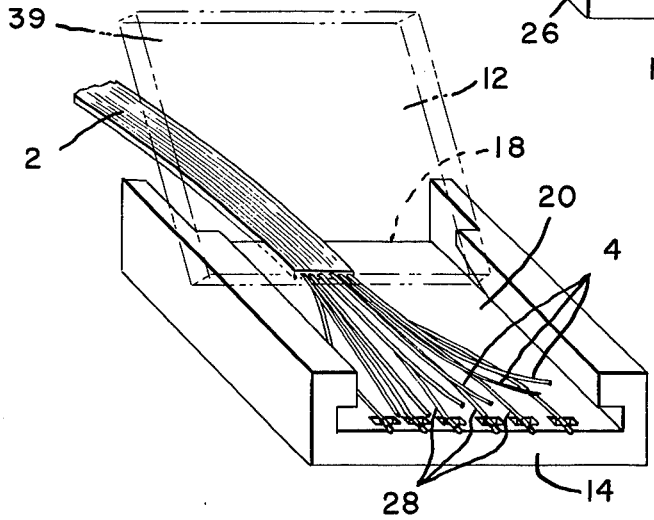
Figure 3B:
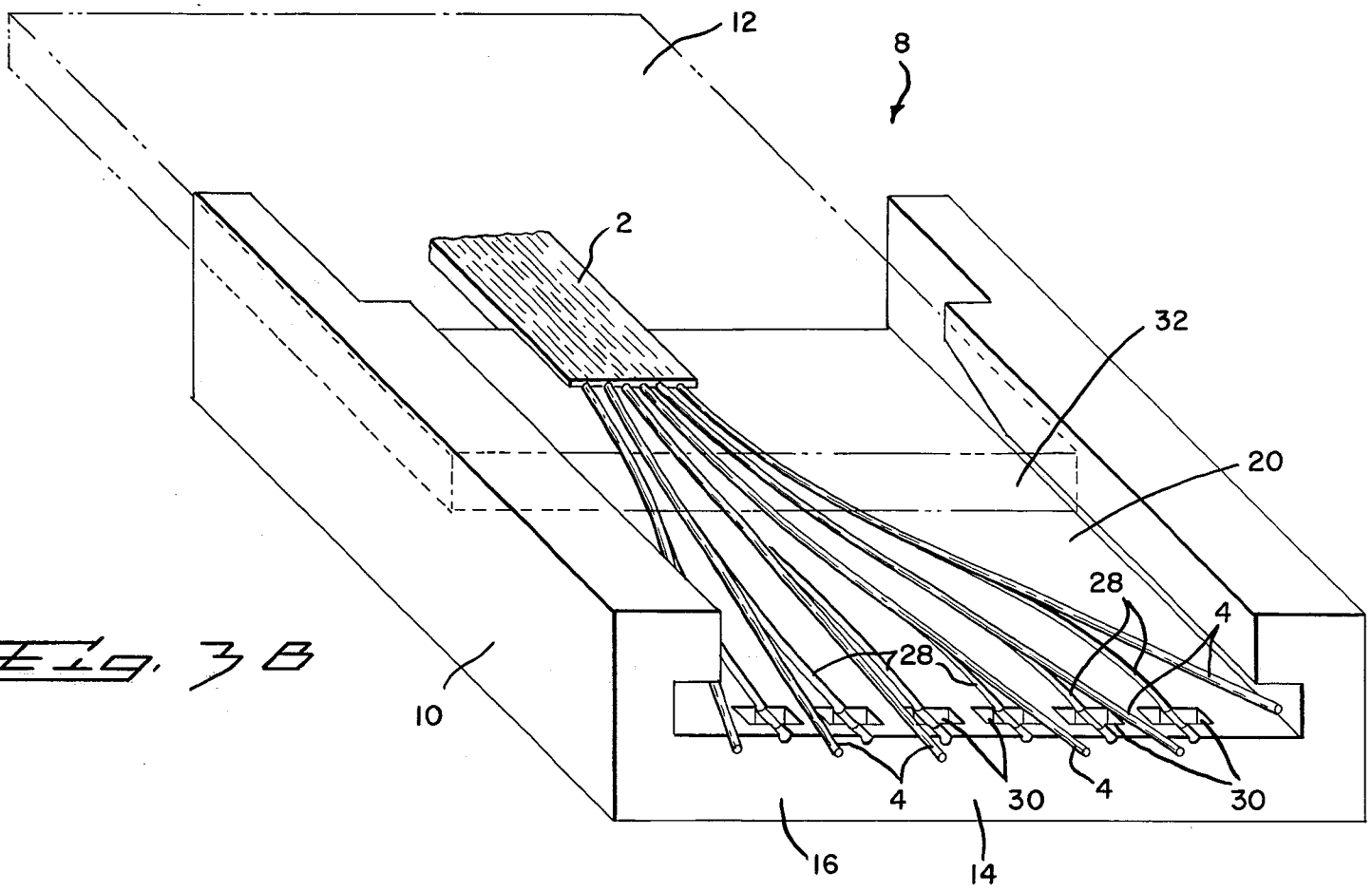
Figure 4:
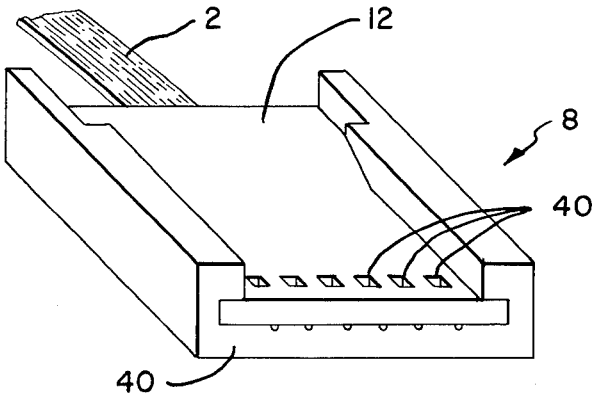
FIG. 4 is a perspective view of the connector after assembly to the cable.

FIGS. 2–4 show an embodiment of the invention comprising a connector 8 having first and second housing parts 10, 12 which may be of suitable insulating material such as glass filled nylon. The first housing part 10 comprises a generally prismatic, relatively thin body 14 having a mating end 16 and a cable receiving end 18. A cable receiving surface 20 extends between the ends 16, 18 and sidewalls 22 extend upwardly from the body on each side edge of this surface. The sidewalls have inwardly directed flanges 24 and are shown cut away adjacent to the end 18. Downwardly inclined ramp surfaces 29 are provided on these flanges at their rearward ends to guide the housing part 12 into its assembled position.

A shallow cable receiving indentation 25 is provided on the surface 20 adjacent to the end 18, the width of this recess being equal to the width of the cable 2 so that the end portion of insulation on the cable can be located in the recess as shown in FIG. 3A. A plurality of spreading recesses or channels 28 extend from the inner end of recess 25 to the mating end 16 of the housing part 10. These recesses 28 are shown as generally semi-circular in cross-section and are dimensioned to receive the conductors 4 of the cable. The width and depth of each recess is generally equal to or greater than the diameter of the wires. The recesses are close together at the ends which are adjacent to the depression 25 and as shown they diverge so that they are spaced apart at the mating end 16 of the housing part 10 as shown. The recesses 28 need not continuously diverge. Other prescribed patterns are possible.

Holes 30 extend through the body 14 adjacent to the mating end thereof from the surface 20 here to the underside of the body. These openings intersect the spreading recesses 28.

The second body part 12 is generally rectangular and has a leading end 32 and a trailing end 34. Leading edge 32 is generally slightly radiused. Second body part 12 is dimensioned to be received between the sidewalls 22 of the first body part and to have a sliding fit so that it can be telescopically moved from the cable receiving end 18 of the body part 10 to its fully assembled position shown in FIG. 4. Openings 40 extend through the second body part 12 and contact terminals may be fitted in these openings. The locations of these openings 40 are such that these openings will be in axial alignment with the openings 30 when the two parts are telescopically assembled to each other and are in an assembled configuration.

In use, the insulation at the end of the cable is first removed and the end of the cable is positioned in the indentation 25 so that the conductors will extend forwardly, but more or less randomly, over the surface 20 towards the mating end 16 of the first body part. The second body part is then positioned as shown in FIG. 3 with its leading end 32 against the surface 20 and with the inclined surfaces 29 against the upper surface 39 of the second body part. In some instances the inclined surfaces 29 are not employed and the second body part 12 is not tilted relative to first body part 10. The second body part is next moved relatively forwardly, over the surface 20. During such movement of the second part into the first part the edge 37 at the leading end 32 comprises a transverse element and moves over surface 20. The second body part is precisely guided during this assembly step by virtue of the fact that the side edge portions 36 of the second body part are received in the guide channels 26 of the first body part. As explained in the above-identified U.S. Pat. No. 3,891,013, the individual conductors 4 will be forced into the recesses 28 of the first body part and after the parts have been completely assembled to each other (FIG. 4) the ends of the conductors will extend across the openings 30 and 40.

In FIG. 3B the wire insertion operation is illustrated as partially complete. Note that conductors 4 have been pressed into elongated recesses 28 in the vicinity of cable receiving end 18. The recesses 28 have now begun to diverge as shown. The individual wires 4 have not entered the recesses in the vicinity of the mating end 16. Note particularly that the outer wires have yet to conform to the greater curvature of the outer recesses. Continued movement of second body part 12 across cable receiving surface 20 will progressively press the wires fully into the recesses. In FIG. 4 the wire end portions have been completely encapsulated by the first and second housing parts 10, 12 with the wires 4 confined by recesses 28. The use of six wires is purely for the purpose of illustrating the wire insertion principle. In actual use a larger number of wires could and probably would be handled in a connector of this type.

For example, on specific "transmission" cable contains 20 round conductors and is 1.15 inches (2.92 cm.) wide. A connector in accordance with this invention must be capable of spreading the individual conductors along a prescribed template pattern. In addition the respective conductors must be located in the appropriate position, or in this connector within the appropriate channel or recess. It is critical that each wire actually fit within the appropriate recesses and not be trapped between the sliding second housing part 12 and cable receiving surface 20. Rectangular indentation 25 serves as a first means for insuring that each conductor will initially be aligned with the proper recesses or channel. In some instances it may be necessary to increase the depth of the channel in the vicinity of the indentation 25 to insure that the wires are started in the proper channel. The major portion of each channel could be shallower than the initial section.

Figure 7:
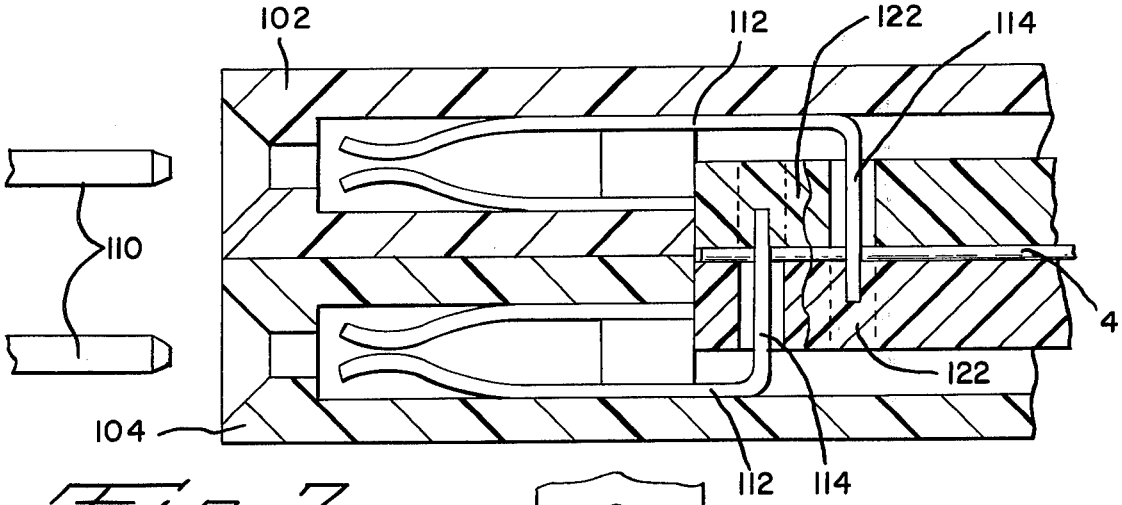
FIG. 7 is a sectional view of the slotted plate wire termination.
Figure 8:
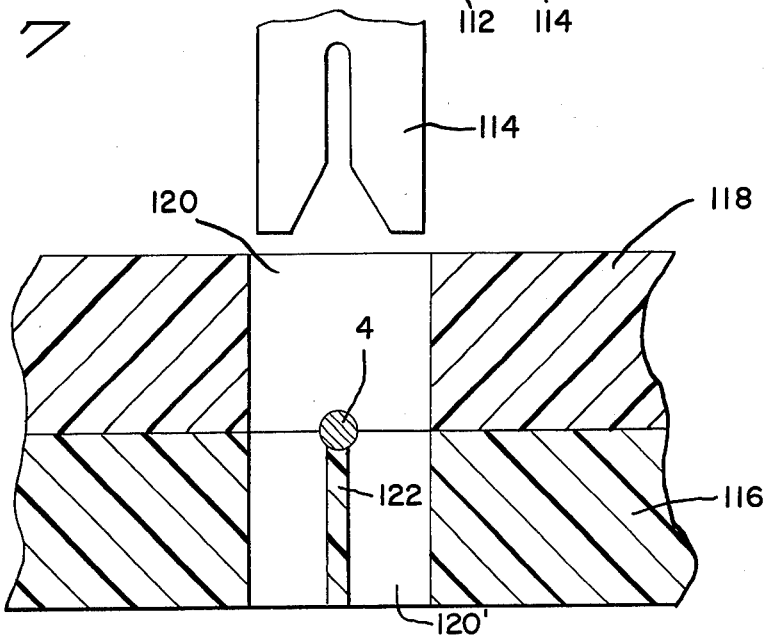
FIG. 8 is another sectional view showing the entry of the slotted plate terminal.
Figure 9:
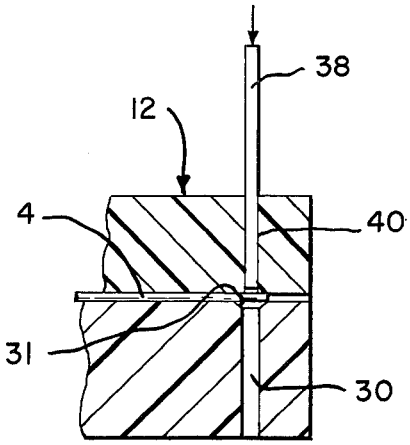
FIG. 9 is a cross-sectional view of an alternate embodiment showing the mating end portion of the connector showing the position of a contact pin prior to insertion of the pin through an opening in one of the housing parts of the connector.
Figure 10:
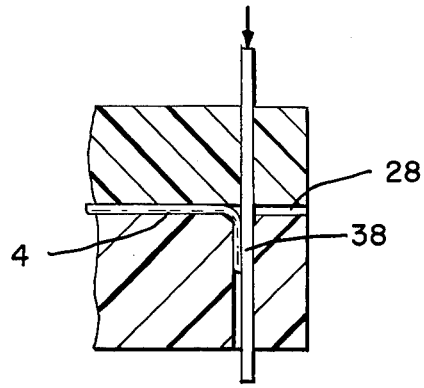
FIG. 10 is a view showing the electrical interconnection between the wire and contact pin.
Figure 11:
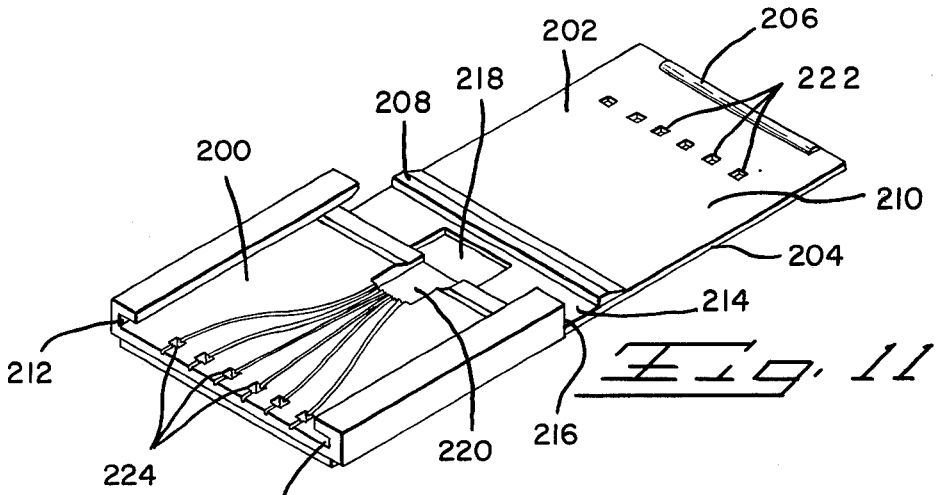
FIG. 11 is a perspective view of a further embodiment, this view showing the positions of the connector parts prior to assembly of the connector to the cable.

Once the wires and the connector 8 are in the fully assembled configuration of FIG. 4, wire termination can be accomplished by inserting contact terminals through aligned holes and openings 30 and 40. This wire termination can be accomplished by numerous techniques. Two such techniques are illustrated herein. FIGS. 5–8 illustrate the termination of twenty conductors by a technique employing a slotted terminal. FIGS. 9 and 10 illustrate another technique employing pins.

Figure 5:
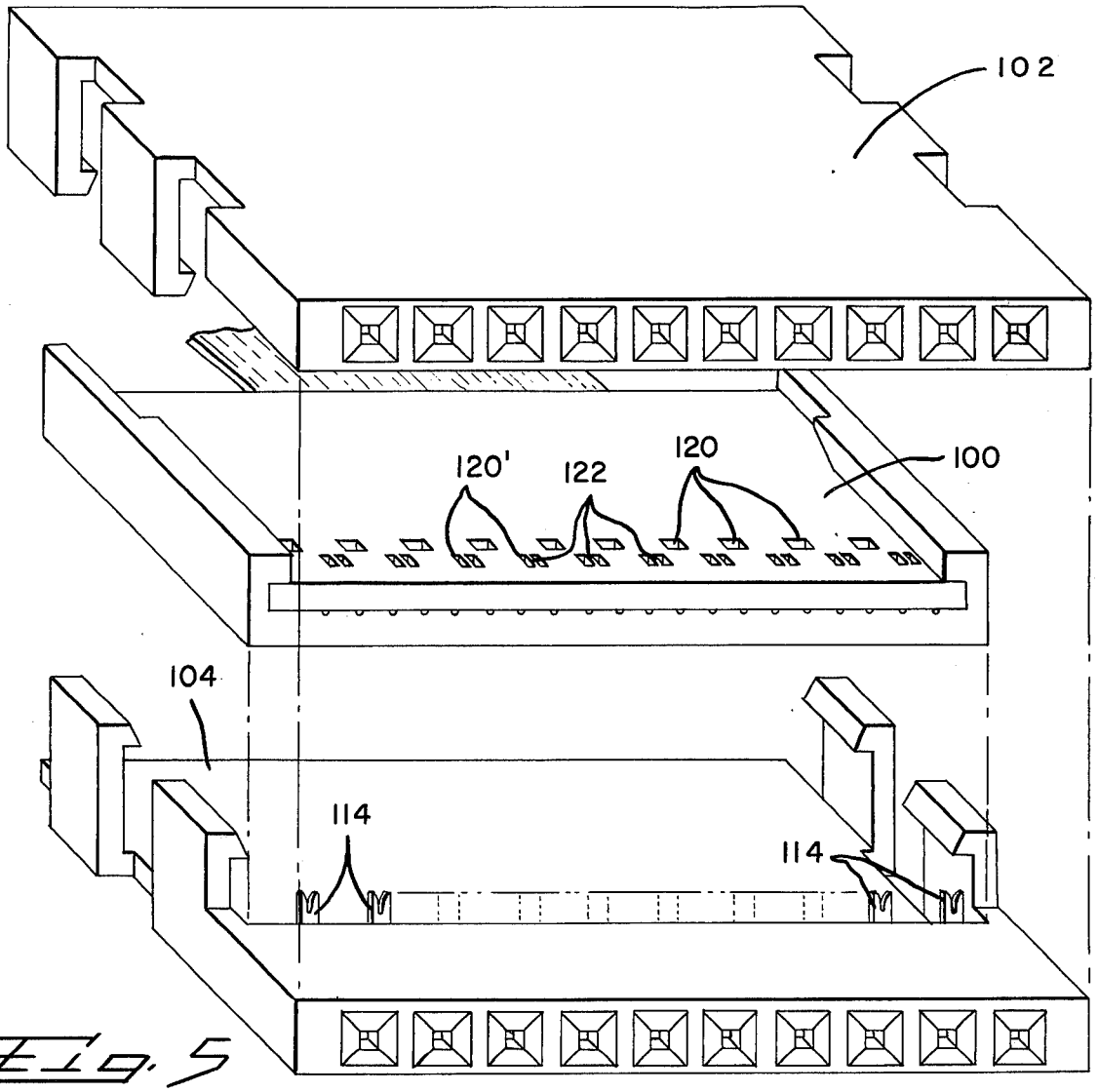
FIG. 5 is an exploded view showing the various elements used for a slotted plate wire termination method used with this connector.
Figure 6:
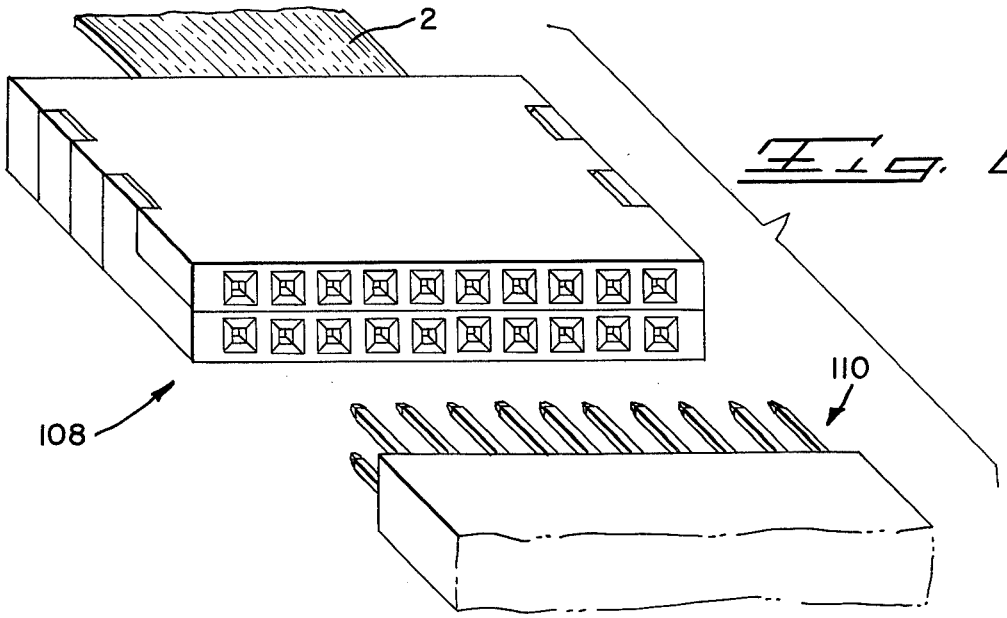
FIG. 6 shows the assembled configuration of the components shown in FIG. 5.

FIG. 5 is an exploded view showing a connector member 100, similar to connector 8 shown in FIG. 4, together with an upper terminal housing member 102 and a lower terminal housing member 104. These three members 100, 102, and 104 can be assembled as shown in FIG. 6 to form a terminal post connector 108. Connector 108 can be used to mate the individual wires in a multi-conductor transmission cable, against designated as 2 with an array of terminal posts 110.

Each terminal housing member 102 and 104 has a plurality of contact terminals 112 having slotted plates 114 adjacent one end thereof. Post contact members 116 are located at the opposite end thereof. Slotted plates 114 are intended to form an electric contact with a wire 4 as shown in FIGS. 7 and 8. Each wire has been captured by first and second housing parts 116, 118 of connector 100. First and second housing parts 116, 118 are analogous to first and second housing parts 10, 12 shown in FIGS. 2–4. During assembly of terminal post connector 108 slotted plates 114 pass through openings 120, 120' in first and second housing parts 116 and 118 as shown. Each wire is supported by a web 122 which extends across openings 120, 120' in the direction of the path of wires 4. It should be evident that webs 122 are located only in those openings 120 which are opposite the point of entry of slotted plates 114.

FIGS. 9 and 10 illustrate another termination concept utilizing round pins 38. When round pins 38 are used as shown it should be understood that openings 30 and 40 have a similar circular cross section.

The contact pins are driven downwardly until their upper ends are flush with the upper surface 39 and their lower ends 42 project beyond the lower surfaces of body part 10. During such downward movement of the pins, they will bend the conductors downwardly into the openings 30 and clean any thin surface oxide from the surfaces of the conductors so that electrical contact will be established between the pins and the conductors. It will be apparent that a snug frictional fit is desirable to achieve this effect. The projecting ends 42 of the pins can then be connected to further conductors, for example, they can be soldered to conductors in a printed circuit board.

FIGS. 11–14 show a further embodiment in which the housing parts are integrally molded on a strip 82 of thin flexible polymeric material such as polyethelene terephthalate. This embodiment comprises first housing part 200 and flexible cover member 202. The first housing part 200 being substantially similar to the previously described first housing part 10 so that again, a detailed description is not required. The molded housing parts may be integrally molded on the strip 204 by molding techniques of the general class in which the strip is fed through the mold of the molding machine so that a continuous strip of housing assemblies is produced.

The flexible cover member 202 comprises two transversely extending blocks 206, 208 of molded material and the portion 210 of the strip 204 which lies between the blocks 86–84. The block 206 is dimensioned so that is can slide through the channels 212 of the first housing part 200 and the block 208 is dimensioned so that it will lodge in the rearward ends of these channels when the first and second parts are installed on the cable. The portion 214 of the strip 204 which lies between the block 208 and the cable receiving end 216 of the first housing part serves as a hinge and is provided with an opening 91 for reception of the cable.

Figure 12:
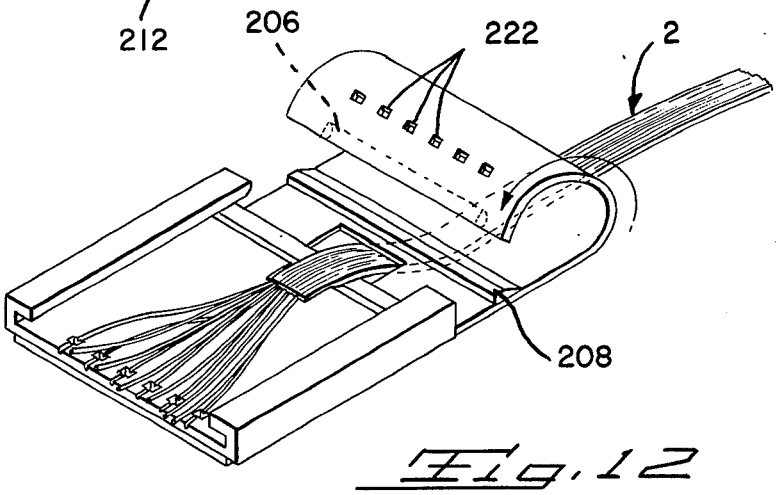
FIG. 12 illustrates the operation of the flexible cover member during cable installation.

The first housing parts 200 and flexible cover 202 are assembled to the cable by passing the cable from below through the opening 218, positioning the end of the insulated portion of the cable in the depression 220, reversely folding the section 210 of the flexible strip as shown in FIG. 12, and moving the block 206 through the channels 212 until the block 206 is located at the mating end of the first housing part 200. It will be noted that openings 222 are provided in the flexible section 210 of the second housing part which are in alignment, after assembly to the cable, with openings 224 in the first housing part.

Figure 13:
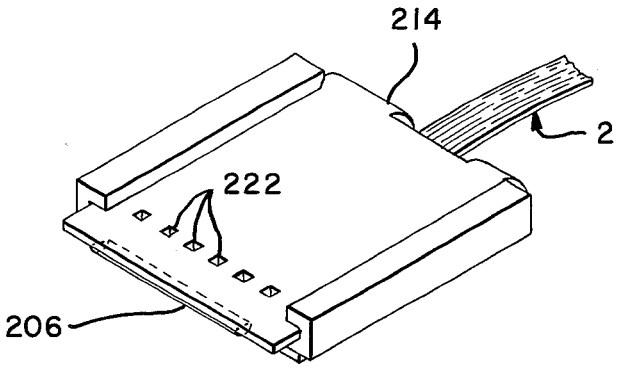
FIG. 13 shows a completely assembled configuration for the alternate embodiment.

Termination of the wires in the fully assembled configuration of FIG. 13 can be accomplished in the same manner as that depicted in FIGS. 5–8 or as shown in FIGS. 9 and 10. Other acceptable methods of termination could surely be used.

Figure 14:
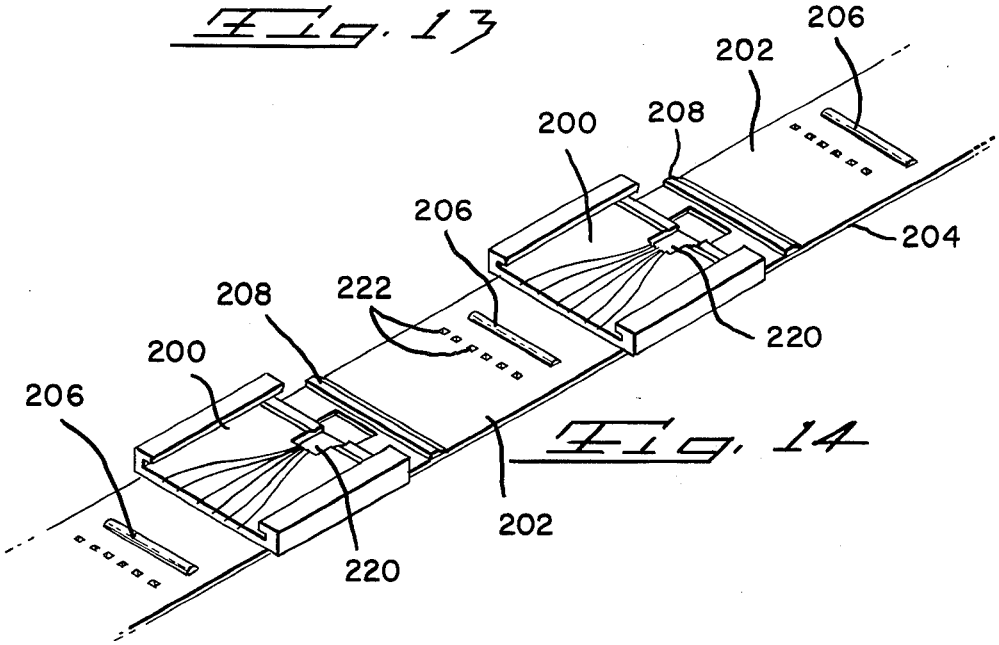
FIG. 14 is a view of the alternate embodiment in strip form.

A convenient method of manufacturing connectors in accordance with the embodiment of FIG. 13 is to mold the housing parts on a continuous strip of thin plastic material as previously explained so that the finished product, FIG. 14, comprises an endless strip of houses, which can be individually removed when needed, with portions of the continuous strip serving as the hinge and flexible cover.

It will be apparent from the foregoing description that the principles of the invention can be used under a wide variety of circumstances where it is desired to connect conductors to contact terminals in a connector. The herein disclosed embodiments are particularly intended for transmission cables having very closely spaced conductors, however, connectors in accordance with the invention can be used for relatively larger conductors than those found in transmission cables if desired. Where the conductors are transmission cables, it may be desirable to strip the insulation from the end of the cable, however, under many circumstances, the insulation stripping step can be avoided. For example, the contact terminals can be of the insulation displacing type, i.e. the type in which each terminal is provided with a narrow slot into which an insulated conductor is moved so that the edges of the slot penetrate the insulation and establish electrical contact with the metallic core of the conductor. Thus, if the conductors shown in FIGS. 5 and 6 were insulated conductors the contact terminals could be provided with an insulation displacing means so that upon movement of the terminals past the conductors, the portions of the conductors which extend past the openings 30 would move relatively into the slots in the terminals to establish the electrical contact.

The principle of the invention could also be used in application where the deployment of the individual wires requires more than the illustrated divergence between differing centerlines. For example, impedance consideration might require that constant spacing between specific ground and signal conductors be maintained for as long as possible. Appropriate template configurations can be utilized to achieve such proper impedance matching. The principles of this invention are therefore applicable to numerous specific configurations which are encompassed within the following claims:

What is claimed is:

1. A multi-contact electrical connector which is intended to be installed on an end portion of a multi-conductor cable, said connector comprising:

first and second electrical connector housing parts of insulating material, said first housing part being generally prismatic and having a mating zone and a cable-receiving end, a cable-receiving surface extending across said first part from said cable-receiving end to said mating zone, a plurality of conductor spreading recesses extending across said cable-receiving surface from said cable-receiving end to said mating zone, said recesses being in side-by-side parallel relationship at said cable-receiving end and extending along pedetermined paths from said cable-receiving end whereby upon locating said cable on said surface at said cable-receiving end with the conductors of said cable in said recesses and progressively pressing said conductors into said recesses, said conductors will be precisely located in said recesses on said surface in said mating zone, said second housing part being assemblable to said first housing part and having a cable-engaging surface which is against said cable-receiving surface when said second housing part is assembled to said first housing part, said first and second housing parts having cooperable guide means thereon for guiding said parts into assembled relationship by guiding said second part over said cable-receiving surface of said first part from said cable-receiving end to said mating zone of said first part whereby upon locating said cable on said cable-receiving surface and assembling said second part to said first part, said conductors are pressed into said recesses during assembly of said second part to said first part and will be precisely located in said mating zone, and electrical contacting means for establishing electrical contact with said conductors in said mating zone.

2. An electrical connector as set forth in claim 1, said predetermined paths deviating from parallelism on said cable receiving surface.

3. An electrical connector as set forth in claim 2, said predetermined paths extending divergently on said surface from said cable receiving end whereby said conductors are spread apart on said surface.

4. An electrical connector as set forth in claim 1 at least some of said pedetermined paths deviating laterally in said mating zone so that portions of each of said conductors in said mating zone are precisely located at predetermined contact locations in said mating zone, said electrical contacting means having contact terminal means thereon which are located at complementary locations whereby said contacting means engage said conductors at said predetermined locations.

5. A connector as set forth in claim 1, said first housing part having a mating end, said mating zone being at said mating end.

6. A connector as set forth in claim 5, said second connector part having a leading end and a trailing end, said cable-engaging surface extending between said leading end and said trailing end, said cooperable guide means comprising interengaging means on said first and second parts, said interengaging means being effective to locate said leading end of said second part against said cable-receiving surface of said first part at said cable-receiving end and guide said leading end over said cable-receiving surface while maintaining said leading end of said second part against said cable-receiving surface of said first part until said parts are assembled to each other with said cable between said cable-receiving surface and said cable engaging surface and with said conductors in said recesses.

7. A connector as set forth in claim 6, said interengaging means comprising side edge portions of one of said housing parts and channel-like means on the other one of said housing parts, said channel-like means being dimensioned to receive said side edge portions.

8. A connector as set forth in claim 7, said channel-like means being on said first housing part and extending along the side edge portions of said cable-receiving surface.

9. A connector as set forth in claim 5, said first and second parts having terminal receiving openings extending therethrough transversely of said cable supporting surface and said cable engaging surface, said openings being in alignment when said parts are assembled, said openings being proximate to said mating end of said first part and intersecting said conductor spreading recesses, said contacting means comprising contact terminals dimensioned to be received in said openings whereby, upon installing said first and second parts on said cable and inserting said contact terminals into said openings, said contact terminals will electrically contact said conductors.

10. A connector as set forth in claim 9, said contact terminals being dimensioned to extend externally of said housing parts after insertion into said openings to permit establishment of electrical contact with further conductors.

11. A connector as set forth in claim 5, said connector having a third housing part, said third housing part being assemblable to said first and second housing parts at said mating end of said first housing part, said electrical contacting means comprising contact terminal means in said third housing part, said contact terminal means being brought into engagement with said conductors when said third housing part is assembled to said first and second housing parts.

12. A connector as set forth in claim 11, said first and second housing parts having openings extending therethrough normally of said cable-receiving and cable engaging surfaces, said openings being aligned when said first and second parts are assembled to each other, said opening being proximate to said mating end and intersecting said conductor-receiving recesses, said contact terminal means being in said openings when said third housing part is assembled to said first and second housing parts and being in electrical contact with said conductors.

13. A multi-contact electrical connector means which is intended to be installed on a multi-conductor cable of the type comprising a plurality of side-by-side individual conductors embedded in an insulating web, and positioned on predetermined centerlines, said connector means comprising:

a first relatively rigid housing member having a cable-receiving end and a cable-receiving surface extending from said cable-receiving end, a plurality of elongated recesses in said cable-receiving surface extending from the vicinity of said cable-receiving end to contact points arranged in a mating zone spaced from said cable-receiving end, a relatively flexible cover member attached to said housing member and extending from said cable-receiving end, said cover member having a free end spaced from said cable-receiving end, a relatively rigid slider member attached to said free end of said cover member, the length of said slider member being at least equal to the width of said mating zone, and an opening in said flexible cover member adjacent to said cable-receiving end, whereby upon removing at least a portion of said insulating web to separate the conductor end portions, said cable can be inserted through said opening with said conductor end portions lying on said cable-receiving surface, and said slider member can be drawn across said cable receiving surface into an assembled configuration to progressively press said conductor end portions into said elongated recesses thereby aligning said conductors with said contact points.

14. A multi-contact electrical connector means as set forth in claim 13 additionally comprising terminal means for establishing electrical contact with said conductors at said contact points.

15. A multi-contact electrical connector means as set forth in claim 14 comprising a plurality of holes in said flexible cover member adjacent to said slider member, said holes being in alignment with said contact points when said connector means is in said assembled configuration.

16. A multi-contact electrical connector means as set forth in claim 13 additionally comprising guide means extending upwardly from opposite edges of said conductor receiving surface between said cable-receiving end and said mating zone, said guide means engaging said slider member upon movement of said slider member across said cable-receiving surface.

17. A multi-contact electrical connector means as set forth in claim 13 said flexible cover member having a relatively rigid strain relief member adjacent to said opening, said cable being trapped between said strain relief member and said cable receiving surface when said connector means in in said assembled configuration.

18. A multi-contact electrical connector means as set forth in claim 13 wherein said flexible cover member comprises a dielectric film, bonded to said first relatively rigid housing member, said first relatively rigid housing member also comprising a dielectric member.

19. An electrical connector means for use in connecting a multi-conductor cable of the type comprising a plurality of conductors arranged in parallel relationship on a first centerline spacing and embedded in a continuous sheet of insulating material, to a plurality of upstanding electrical contact posts arranged in a row on a second centerline spacing, said second centerline spacing being greater than said first centerline spacing, said electrical connector means comprising:

template means for deploying said individual conductors, after segmenting said cable to separate said conductors adjacent one end of said cable, from said first centerline spacing to said second centerline spacing, said template means comprising.

a housing member having a surface for receiving said conductors a plurality of elongate recesses on said surface, said recesses extending from a first position to a second position on said surface, said recesses being located on said first centerline spacing at said first position and on said second centerline spacing at said second position, said recesses each being adapted to receive only one of said conductors initiallly at said first position at a point intermediate the ends of said one conductor, each recess being adapted to receive the additional increments of said conductor upon simultaneous progressive pressing of said conductors into said recesses, electrical contact means for establishing contact with said conductors on said second centerline spacing at said second point and with said contact posts.

20. An electrical connector means for use in connecting a multi-conductor cable, comprising a plurality of conductors embedded in a common insulating web, selected conductors being located on a first centerline spacing, to an array of electric circuit elements located on a second centerline spacing, said connector comprising:

template means for deploying said individual conductors, after segmenting said cable to separate said conductors adjacent one end of said cable, from said first centerline spacing to said second centerline spacing, said template means comprising, a first housing member having a surface for receiving said conductors, a plurality of elongate recesses on said surface, said recesses extending from a first position to a second position on said surface, said recesses being located on said first centerline spacing at said first position and on said second centerline spacing at said second position, said recesses each being adapted to progressively receive at least one of said conductors upon progressively pressing said conductors into said recesses, a second housing member mateable with said first housing member, and a plurality of electrical contact terminals mounted on said second housing member, each of said terminals comprising, terminating means for establishing electrical contact with said conductors at said second position, contact means for establishing electrical contact with one of said electric circuit elements.

21. An electrical connector means as set forth in claim 20 wherein said template means further comprises first means for aligning said conductors in said cable adjacent said first side.

22. An electrical connector means as set forth in claim 21 wherein said first means comprises a rectangular indentation adjacent said first side for receiving said cable, said recesses merging with said indentation.

23. An electrical connector means as set forth in claim 20 wherein said terminating means comprises an upstanding element for establishing electrical contact with a conductor upon relative motion transverse of the axis of said conductor.

24. An electrical connector means as set forth in claim 23 wherein said first housing member further comprises second means comprising an opening aligned with each said recess for receipt of said upstanding element and support means in alignment with said conductor.

25. An electrical connector means as set forth in claim 24 wherein said upstanding element comprises a plate-like member with a slot extending from one end thereof, said plate-like member moving transverse of the axis of said conductor to establish contact therewith when said first and second housing members are mated.

26. An electrical connector means as set forth in claim 25 wherein said first housing member comprises an insulating member.

27. An electrical connector means as set forth in claim 26 wherein said surface on said first housing member is generally flat with said recesses extending inwardly from said flat surfaces, each of said recesses being dimensioned to form an interference fit with one of said conductors.

28. A method of establishing electrical contact between the individual conductors located on a first centerline spacing in a flat multi-conductor electrical cable of the type having a common insulating web and a plurality of electric circuit elements located on a second centerline spacing, said method comprising the steps of:

stripping the insulation from the free ends of said conductors adjacent one end of said cable, deploying said free conductors from said first centerline spacing to said second centerline spacing by progressively pressing said conductors into recesses on a conductor receiving template, establishing electrical contact with said conductors by mounting a plurality of electrical contact terminals on said template, said contact terminals being positioned on said second centerline spacing, said electrical contact being established upon relative movement, laterally of the axis of said conductors, between said conductors and said terminals.

* * * * *